US006293763B1

(12) United States Patent
Yokomachi et al.

(10) Patent No.: US 6,293,763 B1
(45) Date of Patent: Sep. 25, 2001

(54) GUIDE PASSAGE BETWEEN THE PISTON AND HOUSING OF A COMPRESSOR

(75) Inventors: Naoya Yokomachi; Kazuo Murakami; Kiyoshi Yagi; Takayuki Imai, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/456,938

(22) Filed: Dec. 7, 1999

(30) Foreign Application Priority Data

Dec. 9, 1998 (JP) ..... 10-349865

(51) Int. Cl.[7] ..... F04B 1/12

(52) U.S. Cl. ..... 417/269; 417/569; 92/169.1; 92/172

(58) Field of Search ..... 417/269, 222.2, 417/569; 92/169.1, 172

(56) References Cited

U.S. PATENT DOCUMENTS

| | | | | |
|---|---|---|---|---|
| 1,109,154 | * | 9/1914 | Thomas | 92/169.1 |
| 3,957,140 | * | 5/1976 | Overkott | 37/493.8 |
| 4,189,984 | | 2/1980 | Tankred et al. . | |
| 4,311,127 | * | 1/1982 | Mayer | 123/557 |
| 4,350,083 | | 9/1982 | Gannaway . | |
| 4,610,606 | | 9/1986 | Hazzard et al. . | |
| 5,149,254 | * | 9/1992 | Riffe | 417/569 |
| 5,346,373 | | 9/1994 | Riffe . | |
| 5,380,163 | * | 1/1995 | Fujii et al. | 417/269 |
| 5,411,055 | * | 5/1995 | Kane | 137/513.5 |
| 5,492,459 | | 2/1996 | Burkett et al. . | |
| 5,562,425 | * | 10/1996 | Kimura et al. | 417/269 |

FOREIGN PATENT DOCUMENTS

| | | | | |
|---|---|---|---|---|
| 0881386A2 | | 12/1998 | (EP) . | |
| 58-2481 A | * | 1/1983 | (JP) | 92/169.1 |
| 08-261150 | | 10/1986 | (JP) . | |
| 10-068382 | | 3/1998 | (JP) | 92/169.1 |
| WO96/34200 | | 10/1996 | (WO) . | |

* cited by examiner

*Primary Examiner*—Cheryl J. Tyler
(74) *Attorney, Agent, or Firm*—Morgan & Finnegan, LLP

(57) ABSTRACT

A compressor includes a piston reciprocating in a cylinder bore. The piston draws refrigerant into and discharges refrigerant from a compression chamber, which is formed between the piston and a valve plate. The valve plate has a discharge port connecting the compression chamber to the discharge chamber. A guide passage facilitates the flow of the refrigerant from the compression chamber to the discharge port. The guide passage is defined in the compression chamber when the piston is located at the top dead center position. This decreases pressure losses that would otherwise occur when the piston is near the top dead center position.

20 Claims, 7 Drawing Sheets

GUIDE PASSAGE BETWEEN THE PISTON AND HOUSING OF A COMPRESSOR

BACKGROUND OF THE INVENTION

The present invention relates to a piston type compressor. More particularly, the present invention pertains to a compressor that decreases pressure loss at the last stage of piston discharge strokes.

Japanese Unexamined Patent Publications Nos. 8-261150 and 10-68382 disclose piston type compressors.

FIG. 11 illustrates part of the piston type compressor of the publications. A piston 81 is reciprocally housed in a cylinder bore 82. A valve plate 95 separates the cylinder bore 82 from a suction chamber 83 and from a discharge chamber 84. The valve plate 95 includes a main plate 85, a first sub plate 89 and a second sub plate 91. The first and second sub plates 89, 91 sandwich the main plate 85. A suction port 86 and a discharge port 87 are formed in the valve plate 95. The first sub plate 89 includes a suction valve flap 88. The suction valve flap 88 corresponds to the suction port 86. The second sub plate 91 has a discharge valve flap 90. The discharge valve flap 90 corresponds to the discharge port 87.

A compression chamber 92 is defined by the end face of the piston 81 and the first sub plate 89 in the cylinder bore 82. When the piston 81 is moved from the top dead center position to the bottom dead center position, that is, when the piston 81 is in the suction stroke, refrigerant gas in the suction chamber 83 is drawn into the compression chamber 92 through the suction port 86 and the suction valve flap 88. When the piston 81 moves from the bottom dead center position toward the top dead center position, that is, when the piston 81 is in the discharge stroke, the gas in the compression chamber 92 is compressed to a predetermined pressure. The gas is then discharged to the discharge chamber 84 through the discharge port 87 and the valve flap 90.

As shown in FIG. 12, the ports 86 and 87 are located radially inside of the wall of the cylinder bore 82.

When the piston 81 is at the last stage of the discharge stroke, that is, when the piston 81 is in the vicinity of the top dead center position, gas in the compression chamber 92 flows to the discharge port 87 through a narrow space between the end of the piston 81 and the first sub plate 89. This causes a pressure loss. The pressure loss decreases the compression efficiency of the compressor.

Compressors that are used in vehicle air conditioners typically use fluorocarbon as refrigerant. However, the recent trend is to replace fluorocarbon by carbon dioxide to decrease the influence of the refrigerant on the environment.

Carbon dioxide refrigerant requires a higher compression rate (for example, ten times higher) than fluorocarbon refrigerant. Thus, the pressure loss mentioned above is much more significant in compressors using carbon dioxide as a refrigerant.

SUMMARY OF THE INVENTION

Accordingly, it is an objective of the present invention to provide a compressor that decreases pressure loss at the last stage of the piston discharge stroke.

To achieve the above objective, the present invention provides a compressor. The compressor comprises a housing, a cylinder bore formed in the housing, a suction chamber formed in the housing, a discharge chamber formed in the housing. A discharge port connects the discharge port to the cylinder bore. A piston is located in the cylinder bore. The piston moves from a top dead center position to a bottom dead center position to draw refrigerant gas into the cylinder bore from the suction chamber. The piston moves from the bottom dead center position to the top dead center position to discharge refrigerant gas to the discharge chamber. A compression chamber is defined by an enclosure. The enclosure is formed by the piston and the housing. A guide passage facilitates the flow of compressed gas from the compression chamber to the discharge port. The guide passage is defined in the enclosure when the piston is located substantially at the top dead center position.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor 10 according to a first embodiment of the present invention will now be described with reference to FIGS. 1 to 4. The compressor 10 is used in an air conditioner.

Figure 3:
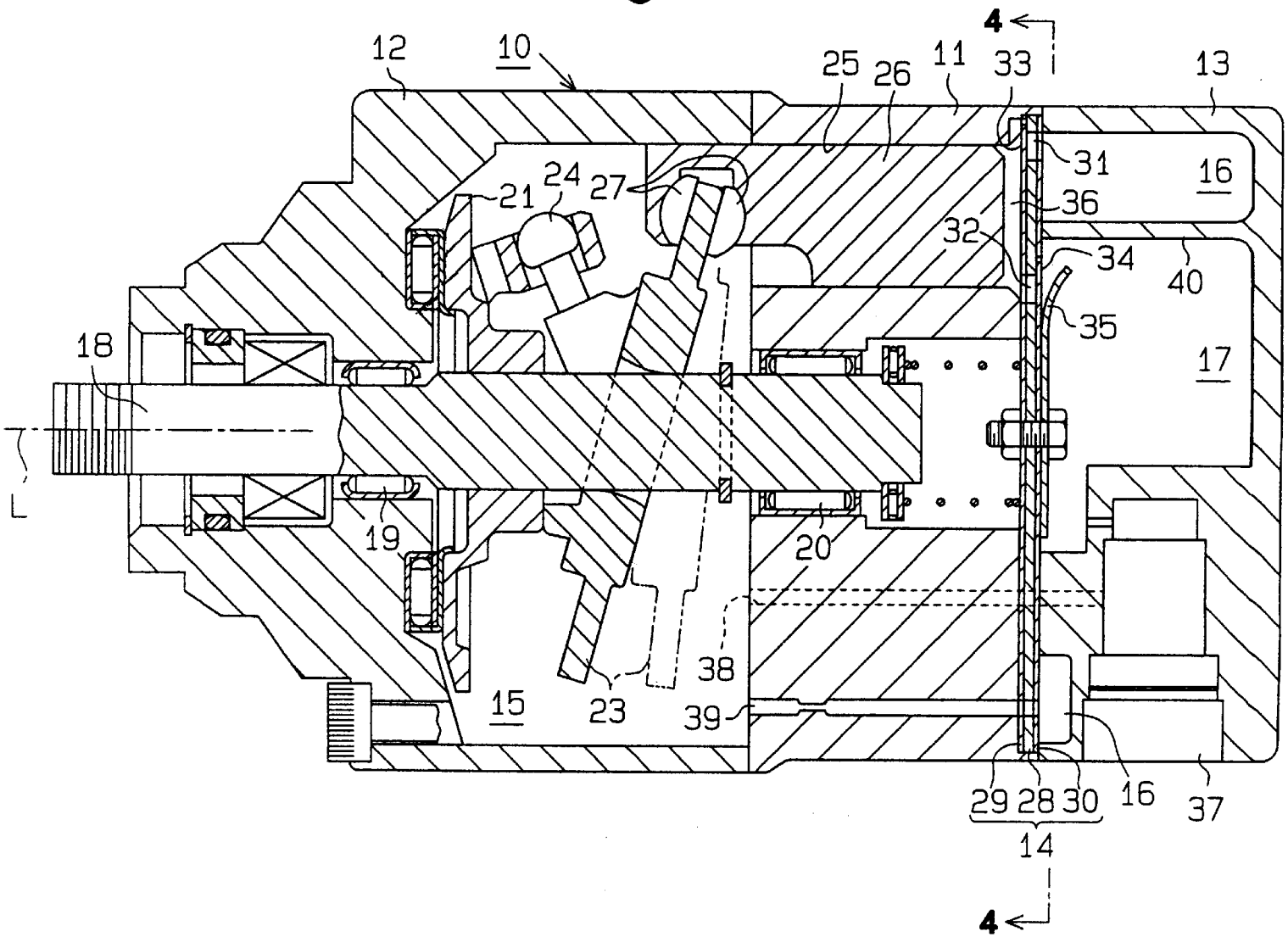
FIG. 3 is a cross-sectional view of the compressor shown in FIG. 1.

As shown in FIG. 3, the compressor 10 is a variable displacement type compressor. The compressor 10 uses carbon dioxide as the refrigerant. A front housing 12 and a rear housing 13 are secured to a cylinder block 11. A valve plate 14 is located between the cylinder block 11 and the rear housing 13. The cylinder block 11, the front housing 12, the rear housing 13 and the valve plate 14 form the housing of the compressor 10. A crank chamber 15 is defined between the front housing 12 and the cylinder block 11. A suction chamber 16 and a discharge chamber 17 are defined in the rear housing 13.

The cylinder block 11 and the front housing 12 rotatably support a drive shaft 18 by means of radial bearings 19, 20. A rotor 21 is fixed to the drive shaft 18 in the crank chamber 15. A swash plate 23 is supported on the drive shaft 18 in the crank chamber 15. The swash plate 23 is permitted to incline with respect to and slide along the axis L of the drive shaft 18. The swash plate 23 is coupled to the rotor 21 by a hinge mechanism 24. The swash plate 23 rotates integrally with the rotor 21. The swash plate 23 is moved between a maximum inclination position shown by solid lines in FIG. 3 and a minimum inclination position shown by broken line.

Figure 4:
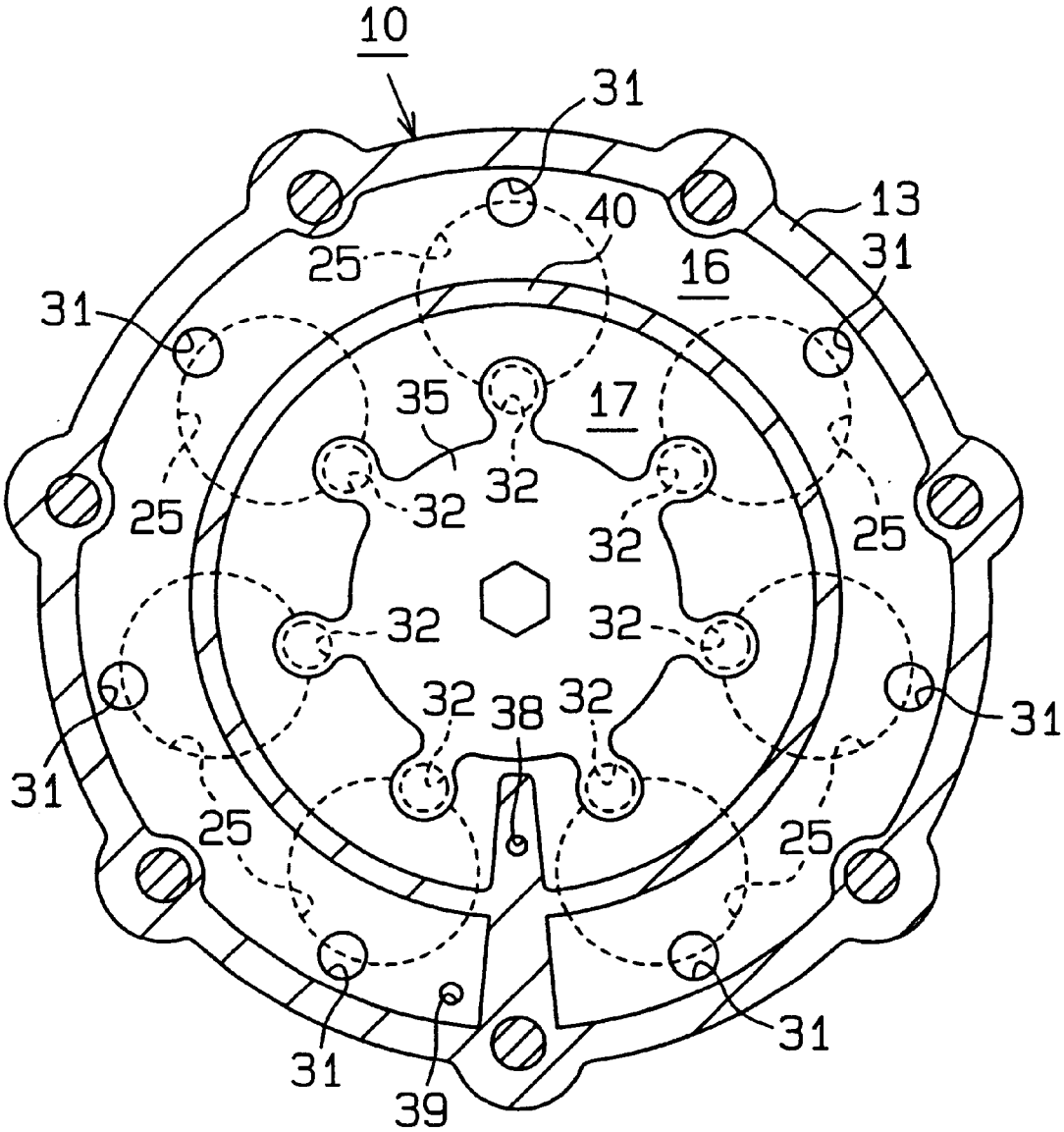
FIG. 4 is a cross-sectional view taken along line 4—4 of FIG. 3.

As shown in FIG. 4, the cylinder block 11 has cylinder bores 25, the number of which is seven in this embodiment. The cylinder bores 25 are all located at the same distance from the axis L of the drive shaft 18 and are spaced apart at equal angular intervals about the axis L of the shaft 18. As shown in FIG. 3, a piston 26 is accommodated in each cylinder bore 25. Each piston 26 is coupled to the swash plate 23 by pair of shoes 27. The swash plate 23 converts rotation of the drive shaft 18 into reciprocation of each piston 26 in the associated cylinder bore 25.

The valve plate 14 includes a main plate 28, first sub plate 29 and second sub plate 30. The first and second sub plates 29 and 30 sandwich the main plate 28. The main plate 28 has suction ports 31 and discharge ports 32. Each suction port 31 and each discharge port 32 correspond to one of the cylinder bores 25. The first sub plate 29 has suction valve flaps 33, each of which corresponds to one of the suction port 31. The second sub plate 30 has discharge valve flaps 34, each of which corresponds to one of the discharge ports 32. The suction ports 31 connect the suction chamber 16 with the cylinder bores 25. The discharge ports 32 connect the discharge chamber 17 with the cylinder bore 25, respectively. The maximum opening degree of each discharge valve flap 34 is restricted by a retainer 35.

The end face of each piston 26 and the first sub plate 29 define a compression chamber 36 in the associated cylinder bore 25. The walls of the cylinder bores 25, the valve plate 14, and the pistons 26, which are accommodated in the cylinder bores 25 form the compression chambers 36. That is, the housing of the compressor 10 and the pistons 26 form an enclosure defining the compression chambers 36 in the cylinder bores 25.

When each piston 26 is moved from the top dead center position to the bottom dead center position, that is, when each piston 26 is in the suction stroke, refrigerant gas in the suction chamber 16 is drawn into the associated compression chamber 36 through the suction port 31 and the suction valve flap 33. When each piston 26 is moved from the bottom dead center to the top dead center, that is, when each piston 26 is in the discharge stroke, the gas in the associated compression chamber 36 is compressed to a predetermined pressure. The gas is then discharged to the discharge chamber 17 through the associated discharge port 32 and the associated valve flap 34.

The discharge chamber 17 is connected to the crank chamber 15 by a supply passage 38. An electromagnetic valve 37 is installed in the rear housing 13 to regulate the supply passage 38. The crank chamber 15 is connected to the suction chamber 16 by a bleeding passage 39. The bleeding passage 39 has a throttle. The electromagnetic valve 37 regulates the amount of refrigerant gas that flows from the discharge chamber 17 to the crank chamber 15. The pressure of the crank chamber 15 is determined by the rate of gas flow from the discharge chamber 17 to the crank chamber 15 through the valve 37 and the rate of gas flow from the crank chamber 15 to the suction chamber 16 through the bleeding passage 39. That is, the pressure of the crank chamber 15 is adjusted by opening and closing the valve 37.

A controller (not shown) controls current to the electromagnetic valve 37 based on external information such as the temperature detected by a passenger compartment temperature sensor and a target temperature set by a temperature setter. When the valve 37 is closed, the pressure in the crank chamber 15 is lowered, which moves the swash plate 23 to the maximum inclination position. When the valve 37 is opened, the crank chamber pressure is increased, which moves the swash plate 23 to the minimum inclination position. In this manner, the displacement of the compressor 10 is controlled by opening and closing the valve 37.

The number of suction ports 31 and the number of discharge ports 32 are both seven. As shown in FIG. 4, the suction chamber 16 and the discharge chamber 17 are separated by an annular wall 40, which extends from the inner surface of the rear housing 13. Each suction port 31 is located at the opposite side of the wall 40 from the corresponding discharge port 32. The second sub plate 30 is not illustrated in FIG. 4.

Figure 1:
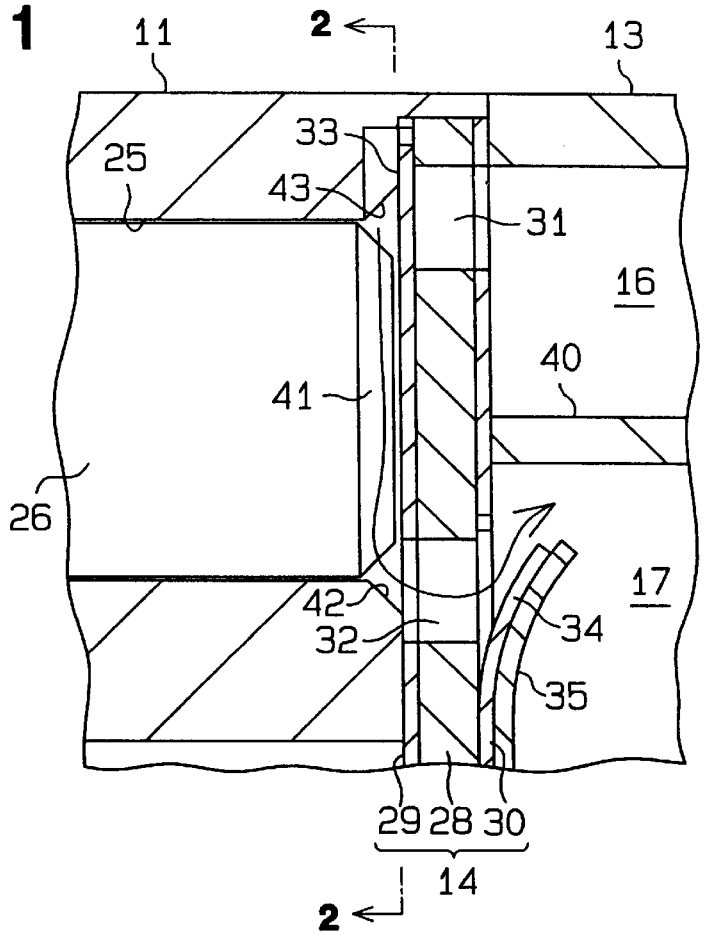
FIG. 1 is a partial cross-sectional view illustrating a compressor according to a first embodiment of the present invention.
Figure 2:
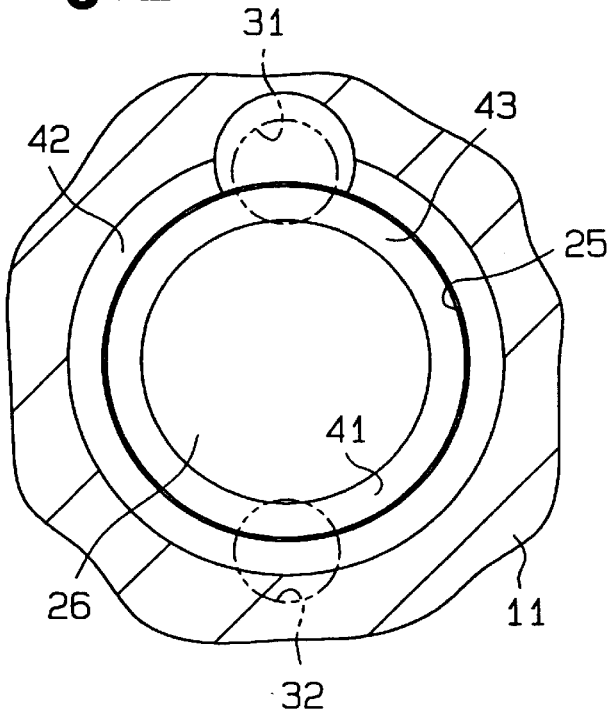
FIG. 2 is a cross-sectional view taken along line 2—2 of FIG. 1.

As shown in FIGS. 1 and 2, part of each suction port 31 and part of each discharge port 32 are located radially inside of the wall of the corresponding cylinder bore 25. The rest of each suction port 31 and the rest of each discharge port 32 are radially outside of the corresponding cylinder bore 25.

The thermophysical property of carbon dioxide allows the volume of each cylinder bore 25 to be relatively small. Thus, the diameter of each cylinder bore 25 is approximately half of the diameter of a cylinder bore in a compressor using fluorocarbon as refrigerant. The diameter of each cylinder bore 25 is about ten to twenty millimeters. The diameter of the suction ports 31 and the discharge ports 32 is about four to five millimeters.

The wall 40 separates the suction chamber 16 from the discharge chamber 17. In other words, the wall 40 is located between the suction ports 31 and the discharge ports 32. Therefore, if the size of the cylinder bores 25 and the ports 31, 32 are in the above mentioned range, part of each suction port 31 or part of each discharge port 32 can be located radially outside of wall of the corresponding cylinder bore 25.

As shown in FIGS. 1 and 3, the end of each piston 26 is machined to have a chamfered surface 41. The open end of each cylinder bore 25 is also machined to include a chamfered surface 42. As shown in FIG. 1, when the piston 26 is substantially at the top dead center position, that is, when the piston 26 at the final stage of the discharge stroke, the piston chamfered surface 41 and the cylinder chamfered surface 42 define an annular guide passage 43 in the compression chamber 36. The guide passage 43 extends about the entire circumference of the piston 26 and communicates with the discharge port 32.

The cross-sectional area of the guide passage 43 is determined to reduce the friction applied to the refrigerant gas flowing through the passage 43. However, if the volume of the space at the end of each piston 26, or the volume of dead space, is too large when the piston 26 is at the top dead center position, the volumetric efficiency of the compressor 10 deteriorates. The cross-sectional area of the guide passage 43 is determined such that the compressor volumetric efficiency does not deteriorate significantly. Specifically, the width of each of the chamfered surfaces 41, 42 is between 0.5 and 1.0 millimeters. The "width" refers to a measurement taken along the face of the chamfered surface 41, 42.

As shown in FIG. 1, at the last stage of the discharge stroke, that is, when the piston 26 is in the vicinity of the top dead center, the top clearance, or the space between the piston end and the first sub plate 29 is relatively narrow (for example, one millimeter). In this state, refrigerant gas in the area far from the discharge port 32, that is, refrigerant gas in the vicinity of the suction port 31, smoothly flows along the arrow of FIG. 1 in the guide passage 43 toward the discharge port 32. Also, refrigerant gas is moved radially outward from the center of the piston end toward the periphery as the piston 26 moves closer to the first sub plate 29. The gas is then smoothly conducted to the discharge port 32 by the guide passage 43. Some refrigerant gas flows directly to the discharge port 32 through the narrow space between the piston end and the first sub plate 29.

The embodiment of FIGS. 1 to 4 has the following advantages.

In the discharge stroke of a piston 26, refrigerant gas in the compression chamber 36 is smoothly conducted to the discharge port 32 through the guide passage 43. Thus, the pressure loss at the last stage of the discharge stroke is reduced, which improves the compression efficiency of the compressor 10. The compressor 10 uses carbon dioxide as the refrigerant. Thus, the refrigerant is compressed to a relatively high pressure. However, since the pressure loss at the last stage of the discharge stroke is reduced, the construction shown in FIGS. 1 to 4 is particularly suitable for compressors using carbon dioxide. The guide passage 43 is located along the entire circumference of the end of each piston 26. Thus, a relatively large amount of refrigerant gas is smoothly conducted to the discharge port 32 through the guide passage 43, which further reduces the pressure loss.

As shown in FIGS. 1 and 2, part of each suction port 31 and part of each discharge port 32 are radially outside of the cylinder bore 25. This arrangement of the ports 31, 32 does not prevent the guide passage 43 from smoothly conducting refrigerant gas to the discharge port 32.

The chamfered surfaces 41, 42 formed on each piston 26 and each cylinder bore 25 define the guide passage 43. The chambers 41, 42 are easily formed by machining, which reduces the manufacturing costs. Further, the chamfered surfaces 41, 42 are formed more easily than grooves. Also, forming the chamfered surfaces 41, 42 eliminates the corners, at which stress concentrates, from the pistons 26 and the cylinder bores 25. The durability of the compressor 10 is therefore improved.

The chamfered surfaces 41, 42 are formed both on the pistons 26 and the cylinder bores 25 to form the guide passages 43. Therefore, even if the chamfered surface 41 on each piston 26 is small, the chamfered surface 42 formed on the cylinder bore 25 guarantees that the guide passage 43 has a sufficient size.

The chamfered surface 42 in each cylinder bore 25 smoothly conducts gas from the compression chamber 36 to the discharge port 32, which reduces the pressure loss in the vicinity of the inlet of the discharge port 32.

Figure 5:
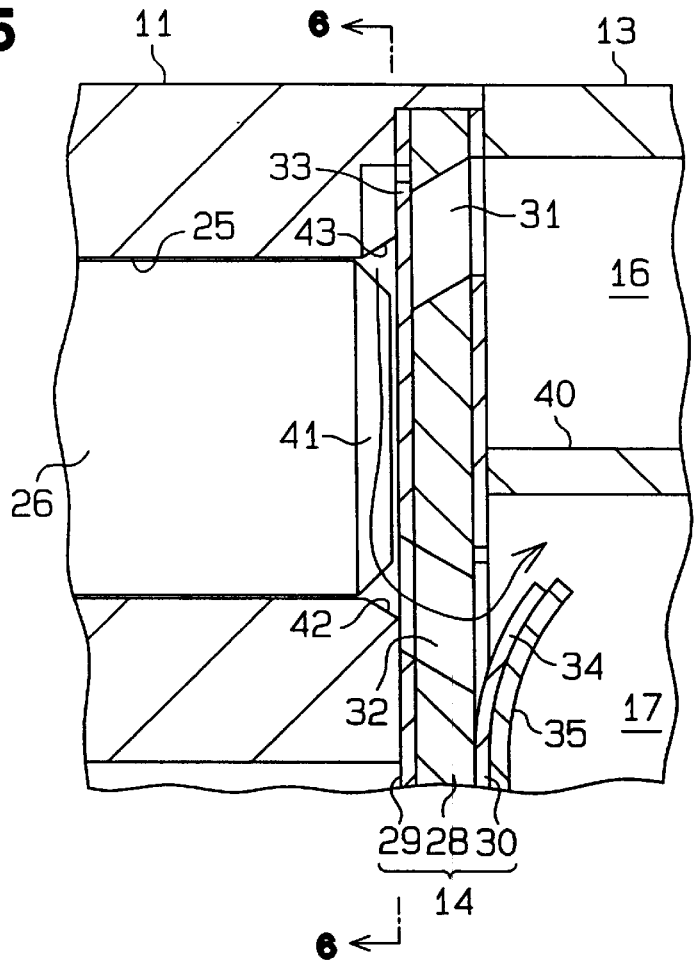
FIG. 5 is a partial cross-sectional view illustrating a compressor according to a second embodiment.
Figure 6:
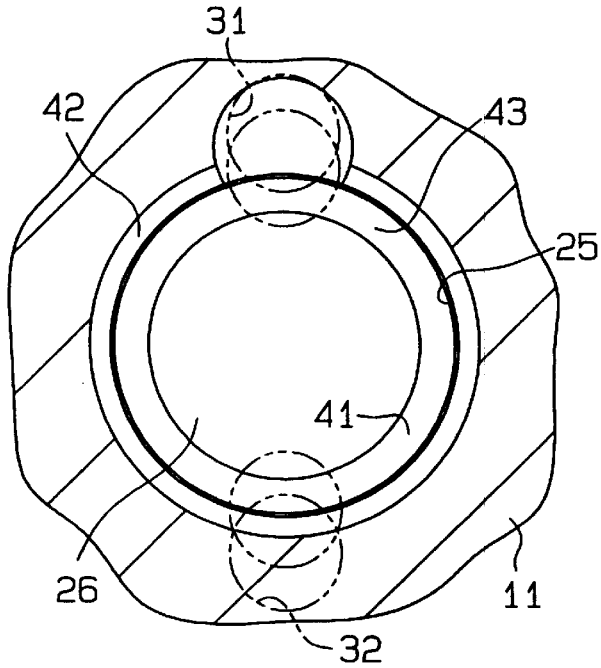
FIG. 6 is a cross-sectional view taken along line 6—6 of FIG. 5.

FIGS. 5 and 6 illustrate a second embodiment. In the embodiment of FIGS. 5 and 6 is the same as the embodiment of FIGS. 1 to 4 except for the shape of ports 31, 32.

As shown in FIGS. 5 and 6, the suction port 31 and the discharge port 32 are inclined with respect to the axis of the cylinder bore 25. Specifically, the ports 31, 32 extend in the direction of gas flow caused by the chamfered surface 41 of the piston 26. The axes of the ports 31, 32 extend symmetrically to each other and substantially at a right angle to the chamfered surface 41. The ports 31, 32 are also substantially parallel to the angle of the chamfered surface 42.

In addition to the advantages of the embodiment of FIGS. 1 to 4, the embodiment of FIGS. 5 and 6 has the following advantages.

In the discharge stroke of each piston 26, the chamfered surface 41 pushes refrigerant gas in the associated compression chamber 36 in the direction of the discharge port 32. The gas is smoothly guided to the discharge port 32 by the chamfered surface 42. Therefore, pressure loss caused when gas flows through the discharge port 32 is suppressed. Accordingly, the pressure loss at the last stage of the discharge stroke is further reduced.

The distance between the ports 31, 32 increases toward the suction chamber 16 and the discharge chamber 17 as shown in FIG. 5. Therefore, even if the cylinder bore 25 has a relatively small diameter, the ports 31, 32 are positively connected to the cylinder bore 25 without reducing the thickness of the wall 40 or without reducing the size of the ports 31, 32.

Figure 7:
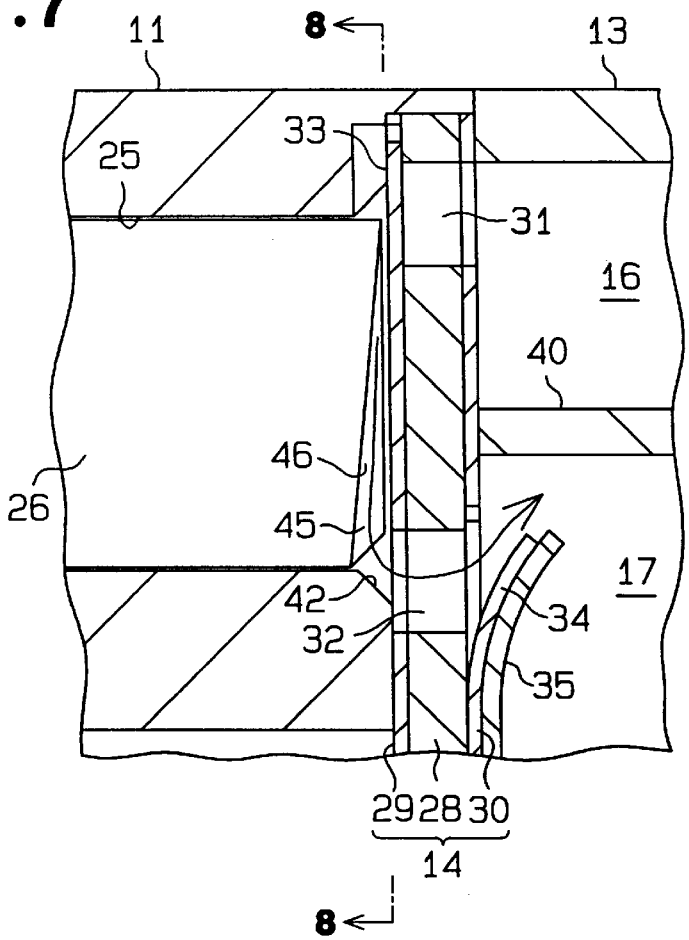
FIG. 7 is a partial cross-sectional view illustrating a compressor according to a third embodiment.
Figure 8:
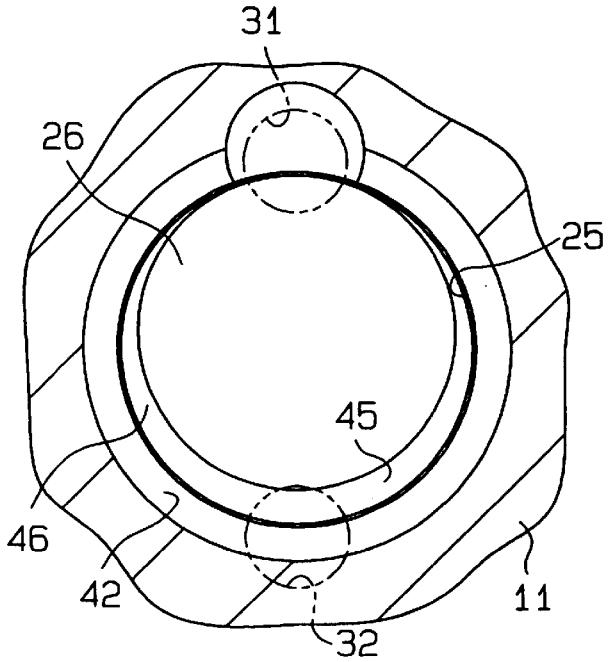
FIG. 8 is a cross-sectional view taken along line 8—8 of FIG. 7.

FIGS. 7 and 8 illustrate a third embodiment. The third embodiment is the same as the embodiment of FIGS. 1 to 4 except for the shape of chamfered surfaces 45 of the piston 26.

As shown in FIGS. 7 and 8, the width of the chamfered surface 45 formed on each piston 26 increases toward the discharge port 32. The cylinder block 11 has the chamfered surface 42, which is the same as the chamfered surface 42 illustrated in FIGS. 1 to 4. When the piston 26 reaches the vicinity of the top dead center position, that is, at the last stage of the discharge stroke, the chamfered surfaces 42, 45 define a guide passage 46, which extends along the circumference of each piston 26. The cross-sectional area of the guide passage 46 increases toward the discharge port 32.

The maximum width of the chamfered surface 45 is slightly greater than the width (for example, 0.5 to 1.0 mm) of the chamfered surfaces 41, 42 of the embodiment of FIGS. 1 to 4. The volume of the space when the piston 26 is at the top dead center position, or the volume of the dead space, is smaller than that of the embodiment of FIGS. 1 to 4.

In addition to the advantages of the embodiment of FIGS. 1 to 4, the embodiment of FIGS. 7 and 8 has the following advantages.

The width of the chamfered surface 45 decreases at locations that are farther away from the discharge port 32. Thus, compared to the embodiment of FIGS. 1 to 4, the compressor of FIGS. 7 and 8 has a smaller dead space, which improves the compression efficiency.

The illustrated embodiments may be modified as follows.

Figure 9:
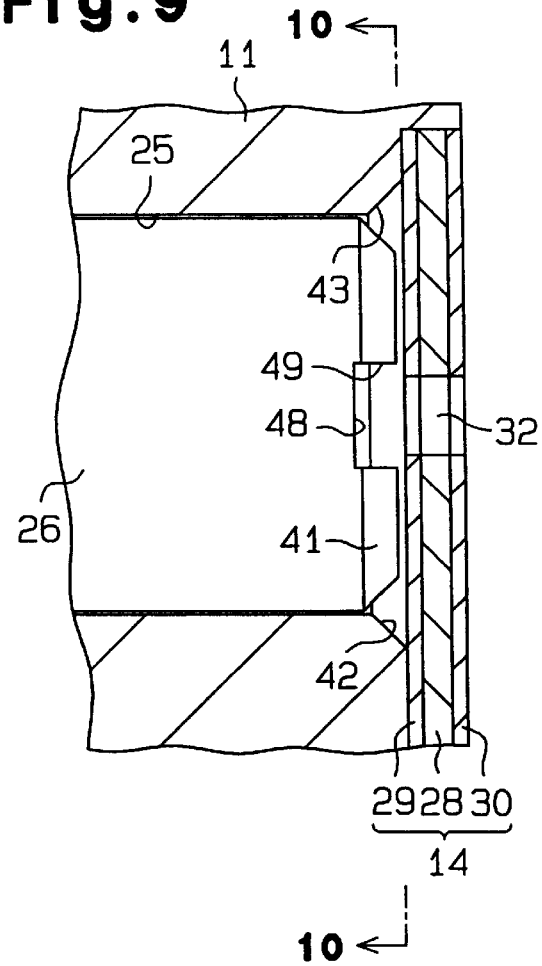
FIG. 9 is a partial cross-sectional view illustrating a compressor according to a fourth embodiment.
Figure 10:
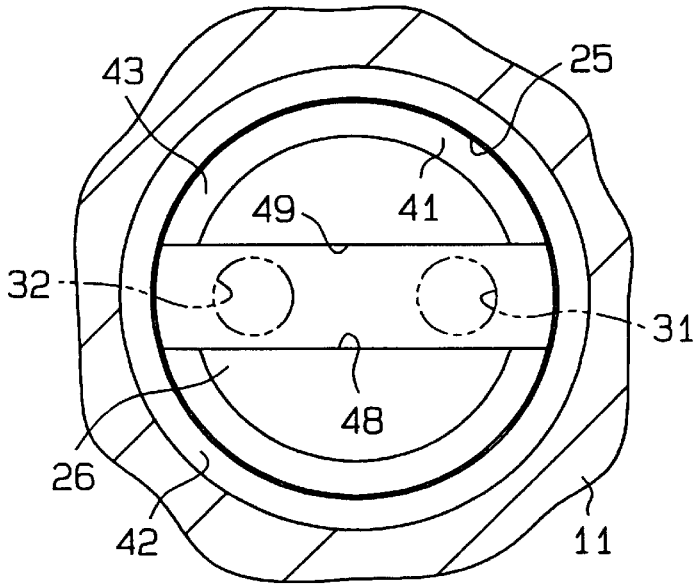
FIG. 10 is a cross-sectional view taken along line 10—10 of FIG. 9.
Figure 11:
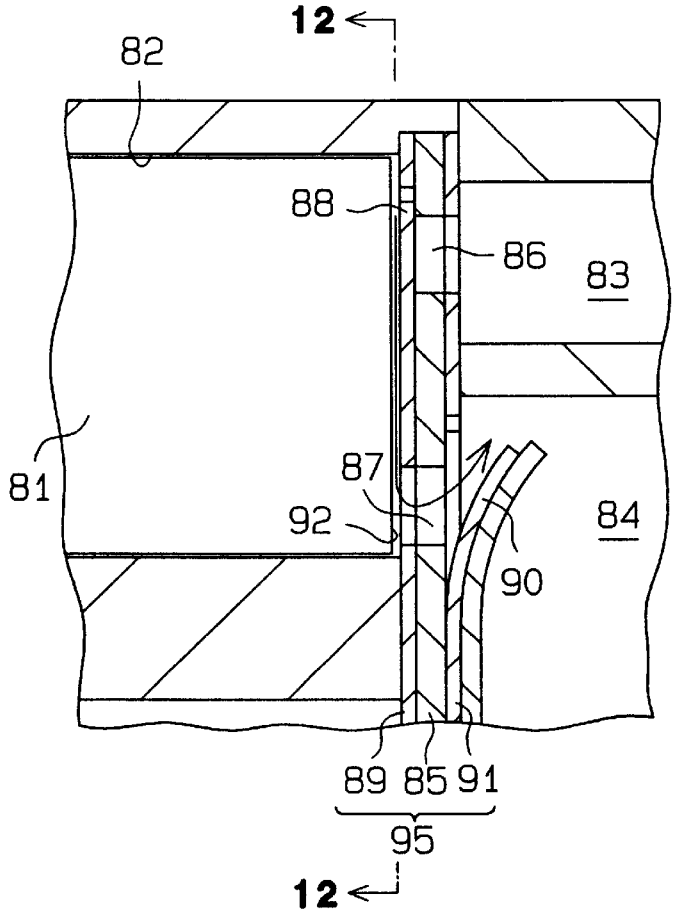
Fig.11 (Prior Art)
FIG. 11 is a partial cross-sectional view illustrating a prior art compressor.
Figure 12:
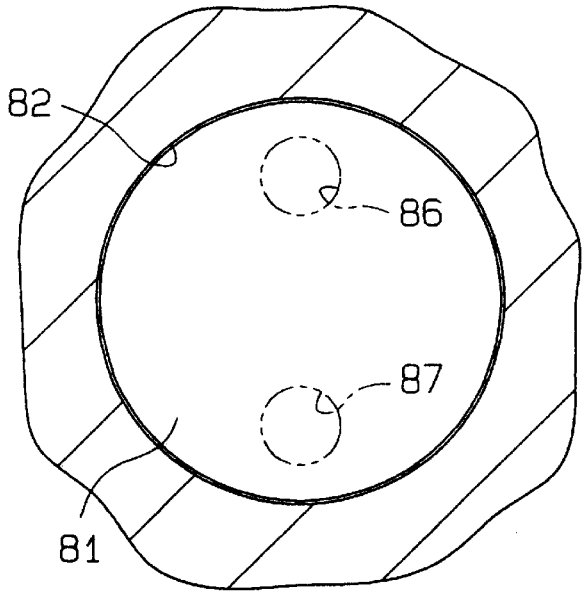
Fig.12 (Prior Art)
FIG. 12 is a cross-sectional view taken along line 12—12 of FIG. 11.

The guide passage does not need to be formed along the circumference of the end face of the pistons 26. For example, as shown in FIGS. 9 and 10, a groove 48 may be formed on the piston end face to define a central guide passage 49 to conduct gas in the compression chamber 36 to the discharge port 32. In the embodiment of FIGS. 9 and 10, the ports 31, 32 are radially inside the wall of the cylinder bore 25. The groove 48 extends along a diametral line connecting the ports 31, 32. The depth of the groove 48 is, for example, 0.5 to 1.0 mm. As in the embodiment of FIGS. 1 to 4, the chamfered surfaces 41, 42 are formed. At the last stage of the discharge stroke of each piston 26, the refrigerant gas can flow in the central guide passage 49 in addition to the peripheral guide passage 43. The chamfered surfaces 41, 42 may be omitted. Permitting gas to flow along the central guide passage 49, which is defined by the groove 48, reduces the pressure loss at the last stage of the discharge stroke. In this case, the refrigerant is not limited to carbon dioxide but may be fluorocarbon.

The chamfered surfaces may be replaced by grooves. For example, a groove having an L-shaped cross-section may be formed between the circumferential surface and the end face of each piston 26. Also, a groove having an L-shaped cross-section may be formed in the inner wall of each cylinder bore 25. In this case, the grooves face each other to define a guide passage.

Furthermore, a guide passage may be defined by a groove formed in the valve plate 14. For example, an annular groove may be formed in the valve plate 14 at the position corresponding to the boundary of each piston 26 and the associated cylinder bore 25. The groove 48 of FIGS. 9 and 10 may be replaced by a groove that is formed on the valve plate 14 and extends along the line connecting each suction port 31 with the corresponding discharge port 32.

It is sufficient to machine just one of the parts that define each compression chamber 36 to form a guide passage. That is, at least one of the cylinder block 11, the pistons 26 the valve plate 14 may be machined to form a guide passage. Guide passages may be defined only by the chamfered surfaces 41 formed on the pistons 26. Alternatively, the guide passage may be defined only by the chamfered surfaces 42 formed on cylinder block 11. If two or more parts are machined to define the guide passages, chamfered surfaces and grooves may be combined to define guide passages. For example, the chamfered surface 41 (45) of each piston 26 may be combined with a groove formed on the inner wall of the associated cylinder bore 25 to define a guide passage.

The guide passages need not extend along the entire circumference of the corresponding piston 26. For example, each guide passage may extend along the half circumference of each piston 26 that corresponds to the discharge port 32.

The guide passage may be defined by means other than chamfered surfaces and grooves formed on the cylinder block 11, the valve plate 14 and the pistons 26. For example, the end face of each piston 26 may be inclined such that the distance between the valve plate 14 and the piston end face increases toward the discharge port 32.

The present invention may be embodied in compressors other than compressors using carbon dioxide as refrigerant. For example, the present invention may be embodied in compressors using fluorocarbon as the refrigerant.

The structure of the illustrated and preferred embodiments may be used in compressors other than single-headed piston type variable displacement compressors. For example, the present invention may be embodied in wobble plate type compressors and fixed displacement compressors.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A compressor comprising:

a housing;

a cylinder bore formed in the housing;

a suction chamber formed in the housing;

a discharge chamber formed in the housing;

a discharge port connecting the discharge chamber to the cylinder bore, wherein part of the discharge port is located radially outside of the cylinder bore;

a piston located in the cylinder bore, wherein the piston moves from a top dead center position to a bottom dead center position to draw refrigerant gas into the cylinder bore from the suction chamber, and the piston moves from the bottom dead center position to the top dead center position to compress and discharge refrigerant gas to the discharge chamber;

a compression chamber defined by an enclosure, wherein the enclosure is formed by the piston and the housing; and a guide passage for facilitating the flow of compressed gas from the compression chamber to the discharge port, wherein the guide passage is defined in the enclosure when the piston is located substantially at the top dead center postion.

2. The compressor according to claim 1, wherein the enclosure has a tapered surface to define the guide passage.

3. The compressor according to claim 2, wherein the piston has a circumferential surface and an end face, the end face being a part of the enclosure, wherein the tapered surface is a chamfered surface formed between the circumferential surface and the end face.

4. The compressor according to claim 3, wherein the chamfered surface is annular.

5. The compressor according to claim 3, wherein the width of the chamfered surface increases at locations closer to the discharge port.

6. The compressor according to claim 3, wherein the axis of the discharge port extends substantially at a right angle to the chamfered surface.

7. The compressor according to claim 2, wherein one end of the cylinder bore is chamfered to form the tapered surface.

8. The compressor according to claim 7, wherein the tapered surface is annular.

9. The compressor according to claim 7, wherein the housing includes a cylinder block, in which the cylinder bore is formed, and a valve plate, which separates the cylinder bore from the discharge chamber, wherein the tapered surface is formed on the cylinder block adjacent to the discharge port.

10. The compressor according to claim 1, wherein the enclosure has a groove formed therein to define the guide passage.

11. The compressor according to claim 10, wherein the groove is formed in an end face of the piston.

12. The compressor according to claim 1, wherein a width dimension of the guide passage, which is measured in the radial direction of the piston, increases at locations closer to the discharge port.

13. The compressor according to claim 1, wherein the housing has a suction port that connects compression chamber to the suction chamber, wherein the distance between the discharge port and the suction port increases as the distance from the compression chamber increases.

14. The compressor according to claim 1, wherein the refrigerant is carbon dioxide.

15. The compressor according to claim 1 further comprising a suction port, wherein part of the suction port is located radially outside of the cylinder bore.

16. A compressor comprising:

a suction chamber;

a discharge chamber;

a cylinder block for having a periphery wall to define a cylinder bore;

a valve plate connected to the cylinder block, wherein the valve plate separates the cylinder bore from the discharge chamber and the suction chamber;

a discharge port formed in the valve plate to connect the discharge chamber to the cylinder bore, wherein part of the discharge port is located radially outside of the cylinder bore;

a piston located in the cylinder bore, wherein the piston moves from a top dead center position to a bottom dead center position to draw refrigerant gas into the cylinder bore from the suction chamber, and the piston moves from the bottom dead center position to the top dead center position to compress and discharge refrigerant gas to the discharge chamber, wherein the piston has a circumferential surface and an end face;

a compression chamber defined by the cylinder block, the valve plate and the piston; and a machined surface formed on at least one of the piston and the cylinder block, wherein the machined surface defines a gas guide passage in the compression chamber to facilitate the flow of compressed gas from the compression chamber to the discharge port when the piston is located substantially at the top dead center position.

17. The compressor according to claim 16, wherein the machined surface is a tapered surface that is located between the circumferential surface and the end face of the piston.

18. The compressor according to claim 16, wherein the machined surface is a tapered surface that is located on one end of the periphery wall of the cylinder block.

19. The compressor according to claim 16, wherein the machined surface is a groove which is formed on the end face of the piston.

20. A compressor comprising:

a housing;

a cylinder bore formed in the housing;

a suction chamber formed in the housing;

a discharge chamber formed in the housing;

a discharge port connecting the discharge chamber to the cylinder, wherein part of the discharge port is located radially outside of the cylinder bore;

a piston located in the cylinder bore, wherein the piston moves from a top dead center position to a bottom dead center position to draw refrigerant gas into the cylinder bore from the suction chamber, and the piston moves from the bottom dead center position to the top dead center position to compress and discharge refrigerant gas to the discharge chamber;

a compression chamber defined by an enclosure, wherein the enclosure is formed by the piston and the housing; and a means for facilitating the flow of compressed gas.

* * * * *

UNITED STATES PATENT AND TRADEMARK OFFICE

CERTIFICATE OF CORRECTION

PATENT NO. : 6,293,763 B1
DATED : September 25, 2001
INVENTOR(S) : Naoya Yokomachi et al.

It is certified that error appears in the above-identified patent and that said Letters Patent is hereby corrected as shown below:

Title page,
Under References Cited, FOREIGN PATENT DOCUMENTS, please change:
"08-261150 10/1986 (JP)" to -- 08-261150 10/1996 (JP) --.

Signed and Sealed this

Twenty-third Day of April, 2002

*Attest:*

*Attesting Officer*

JAMES E. ROGAN
*Director of the United States Patent and Trademark Office*